US007908873B1

(12) United States Patent
Cur et al.

(10) Patent No.: US 7,908,873 B1
(45) Date of Patent: Mar. 22, 2011

(54) MINIMIZED INSULATION THICKNESS BETWEEN HIGH AND LOW SIDES OF COOLING MODULE SET UTILIZING GAS FILLED INSULATION PANELS

(75) Inventors: Nihat O. Cur, Saint Joseph, MI (US); Steven J. Kuehl, Stevensville, MI (US); Marcio Roberto Thiessen, Joinville (BR); Guolian Wu, Saint Joseph, MI (US)

(73) Assignees: Whirlpool Corporation, Benton Harbor, MI (US); Whirlpool S/A (BR)

( * ) Notice: Subject to any disclaimer, the term of this patent is extended or adjusted under 35 U.S.C. 154(b) by 0 days.

(21) Appl. No.: 12/582,726

(22) Filed: Oct. 21, 2009

(51) Int. Cl.
*F25B 1/00* (2006.01)

(52) U.S. Cl. ..... 62/115; 62/440

(58) Field of Classification Search ..... 62/115, 62/440, 444, 449, 268, 269, 270, 80, 151, 62/234, DIG. 13; 312/401, 406; 220/426, 220/592.27

See application file for complete search history.

(56) References Cited

U.S. PATENT DOCUMENTS

| | | | | | |
|---|---|---|---|---|---|
| RE28,712 | E | * | 2/1976 | Klee | 62/216 |
| 4,531,384 | A | * | 7/1985 | Paeye | 62/477 |
| 5,473,901 | A | | 12/1995 | Roseen | |
| 5,512,345 | A | | 4/1996 | Tsutsumi et al. | |
| 6,128,914 | A | | 10/2000 | Tamaoki et al. | |
| 6,550,255 | B2 | | 4/2003 | Rudick et al. | |
| 6,619,070 | B2 | * | 9/2003 | Shin | 62/440 |
| 6,736,472 | B2 | * | 5/2004 | Banicevic | 312/406 |
| 6,938,968 | B2 | | 9/2005 | Tanimoto et al. | |
| 6,955,196 | B2 | | 10/2005 | Giudici et al. | |
| 7,185,507 | B2 | * | 3/2007 | Maglinger et al. | 62/344 |
| 7,219,509 | B2 | * | 5/2007 | Pastryk et al. | 62/344 |
| 7,228,702 | B2 | * | 6/2007 | Maglinger et al. | 62/344 |
| 7,266,972 | B2 | * | 9/2007 | Anselmino et al. | 62/344 |
| 7,361,396 | B2 | | 4/2008 | Miseki et al. | |
| 2003/0201701 | A1 | * | 10/2003 | Banicevic | 312/401 |
| 2006/0076863 | A1 | | 4/2006 | Echigoya et al. | |
| 2006/0086129 | A1 | * | 4/2006 | Anselmino et al. | 62/344 |
| 2006/0086131 | A1 | * | 4/2006 | Pastryk et al. | 62/344 |
| 2006/0086132 | A1 | * | 4/2006 | Maglinger et al. | 62/344 |

* cited by examiner

*Primary Examiner* — Mohammad M Ali
(74) *Attorney, Agent, or Firm* — John W. Morrison; Price, Heneveld, Cooper, DeWitt & Litton, LLP

(57) ABSTRACT

A variable refrigeration system including a cooling system having a compressor, a condenser, and a refrigerant. An active insulation system includes an insulation portion disposed therein that holds a gas. The insulation portion is operably connected to the compressor and includes an insulation panel adjacent a refrigerated compartment. A controller is operably connected to the cooling system and to the active insulation system. The controller operates between a first stage, wherein the controller sends a signal to the compressor to compress the refrigerant in the cooling system, and a second stage, wherein the controller sends a signal to the compressor to alter the gas content in the insulation portion of the active insulation system.

20 Claims, 5 Drawing Sheets

MINIMIZED INSULATION THICKNESS BETWEEN HIGH AND LOW SIDES OF COOLING MODULE SET UTILIZING GAS FILLED INSULATION PANELS

BACKGROUND OF THE PRESENT INVENTION

The present invention generally relates to a cooling system and an active insulation system that are supported by a single compressor.

SUMMARY OF THE INVENTION

In one aspect of the present invention, a variable refrigeration system includes a cooling system having a compressor, a condenser, and a refrigerant. An active insulation system includes an insulation portion disposed therein that holds a gas. The insulation portion is operably connected to the compressor and includes an insulation panel adjacent a refrigerated compartment. A controller is operably connected to the cooling system and to the active insulation system. The controller operates between a first stage, wherein the controller sends a signal to the compressor to compress the refrigerant in the cooling system, and a second stage, wherein the controller sends a signal to the compressor to alter the gas content in the insulation portion of the active insulation system.

In another aspect of the present invention, a refrigerator includes a cooling system having a compressor, a condenser, and a refrigerant. An active insulation system includes an insulation portion with a gas disposed therein. The insulation portion is operably connected to the compressor. A controller is operably connected to the cooling system and to the active insulation system. The controller operates between a first stage, wherein the controller sends a signal to the cooling system to compress the refrigerant, and a second stage, wherein the controller sends a signal to the compressor to alter the gas content in the insulation portion.

In yet another aspect of the present invention, a method of operating a refrigerator includes providing a cooling system having a compressor, a condenser, a fan, and a refrigerant. An active insulation system is provided, which includes an insulation portion operably connected to the compressor. A controller is operably connected to the cooling system and to the active insulation system. The controller is set to operate in a first stage to send a signal to the compressor to compress the refrigerant. The controller is set to operate in a second stage to send a signal to the compressor to alter the gas content in the insulation portion.

These and other features, advantages and objects of the present invention will be further understood and appreciated by those skilled in the art upon studying the following specification, claims, and appended drawings.

DETAILED DESCRIPTION OF EMBODIMENTS

Figure 1:
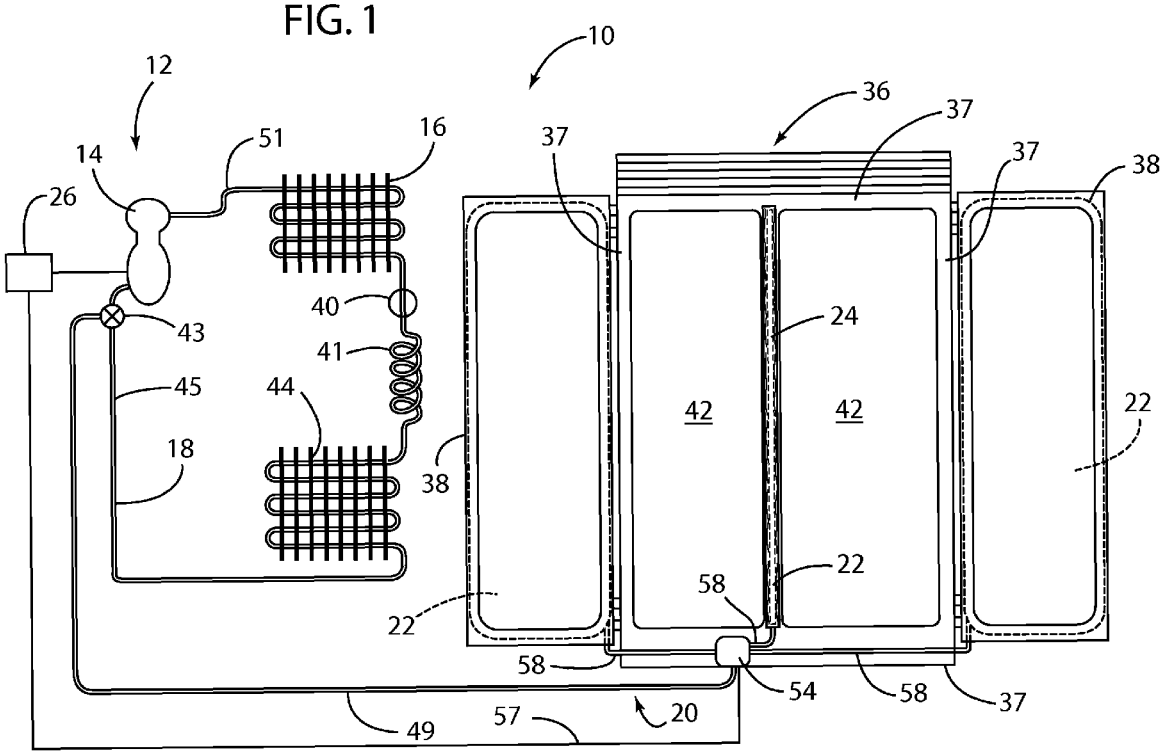
FIG. 1 is a schematic drawing of one embodiment of a refrigeration system of the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
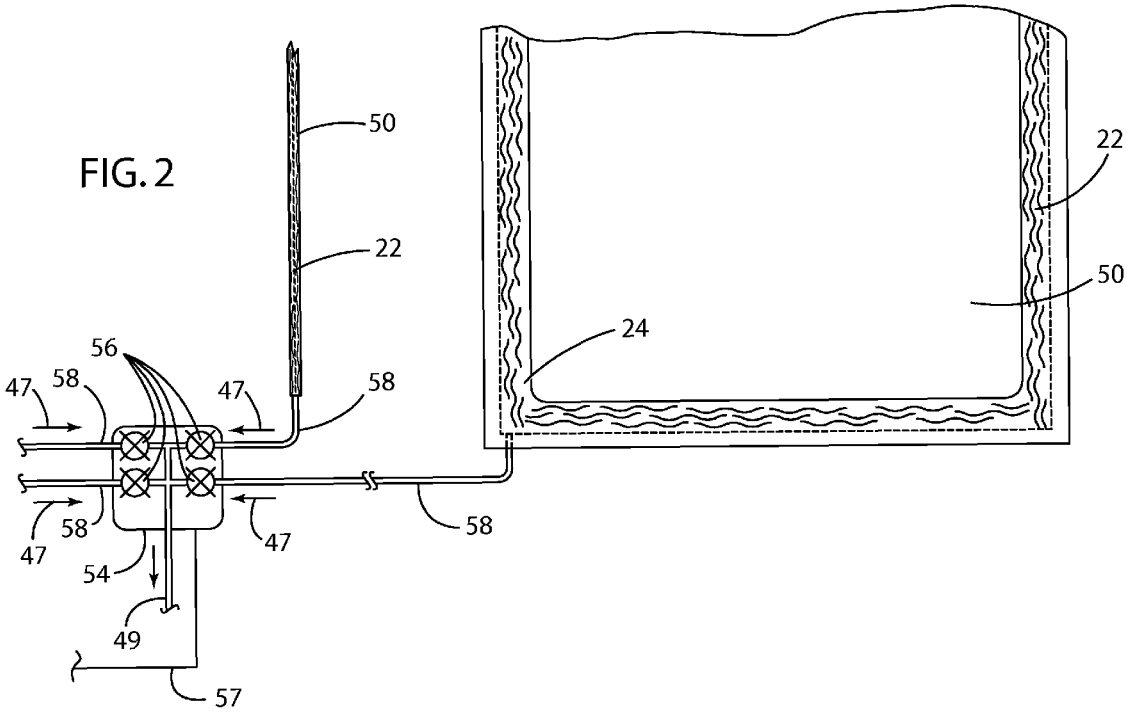
FIG. 2 is an enlarged partial schematic view of the active insulation system of the present invention.

Referring to FIGS. 1 and 2, the reference numeral 10 in the illustrated embodiment generally designates a variable refrigeration system including a cooling system 12 having a compressor 14, a condenser 16, and a refrigerant 18. An active insulation system 20 includes an insulation portion 22 disposed therein that holds a gas 24. The insulation portion 22 is operably connected to the compressor 14. A controller 26 is operably connected to the cooling system 12 and to the active insulation system 20. The controller 26 operates between a first stage, wherein the controller 26 sends a signal to the compressor 14 to compress the refrigerant 18 in the cooling system 12, and a second stage, wherein the controller 26 sends a signal to the compressor 14 to alter the gas content in the insulation portion 22 of the active insulation system 20.

The variable refrigeration system 10 is designed for use in a refrigerator 36 or other atmosphere conditioning appliance having several walls 37 and at least one door 38. At least one insulation portion 22 is disposed in at least one wall 37 or door 38. Each insulation portion 22 includes at least one vacuum insulation panel 50. The refrigerator 36 shown in FIG. 1 includes a side-by-side door configuration, however, it is contemplated that any door configuration with any number of storage compartments 42 may be used in conjunction with the variable refrigeration system 10, as explained in detail below.

Referring now to the embodiment illustrated in FIG. 1, the cooling system 12 of the variable refrigeration system 10 acts to cool the interior storage compartments 42 of the refrigerator 36. The controller 26 is operably connected with the cooling system 12 and sends a signal to the compressor 14 to compress the refrigerant gas 18 when the temperature in the storage compartments 42 has exceeded a predetermined maximum temperature mark. When the compressor 14 activates, the compressor 14 forces the refrigerant 18 into a pressure line 51. The pressure and temperature of the refrigerant 18 increase during compression. The resulting hot, high pressure refrigerant 18 is gaseous at this point and is then condensed to a liquid in the air cooled condenser 16. The condensers 16 are heat exchanging coils and are disposed outside the refrigerator 36 (sometimes on a rear side of the refrigerator 36), and allow the refrigerant 18 to dissipate the heat of pressurization. As the refrigerant 18 cools, the refrigerant 18 maintains liquid form through a filter-dryer 40 (where moisture is absorbed by silica gels and non-condensable gases are bound by getters, such as highly active calcium oxide) and into an expansion device 41.

Referring again to FIG. 1, when the refrigerant 18 flows through the expansion device 41, the liquid refrigerant 18 moves from a high pressure state to a low pressure state, such that the refrigerant 18 expands and evaporates in an evaporator 44 adjacent the interior storage compartments 42 of the refrigerator 36. When the refrigerant 18 evaporates, the refrigerant 18 becomes very cool and absorbs heat from the interior storage compartments 42 of the refrigerator 36, thereby making the interior storage compartments 42 cold. The refrigerant 18 then flows back through the suction line 45. A valve 43 connects the compressor 14 with a refrigeration suction line 45 and an insulation suction line 49. During operation of the cooling system 12, the valve 43 is open to the refrigeration suction line 45, but closed to the insulation suction line 49. Accordingly, the refrigerant 18 flows past the valve 43 and insulation suction line 49 back to the compressor 14 to be compressed again and the cycle continues. Through this entire refrigeration process, the system valve 43 remains closed to the active insulation system 20 but open to the cooling system 12. Accordingly, the compressor 14 draws suction from line 45 but not line 49.

Referring now to FIGS. 1 and 2, the controller 26 communicates with valve 43 and when the insulation portion 22 in the walls 37 or doors 38 of the refrigerator 36 have become depressurized or reached a predetermined pressure, the controller 26 closes valve 43 to line 45 and opens valve 43 to line 49. When the compressor 14 activates, the gas 24 that is inside the insulation portion 22, and specifically, the vacuum insulation panels 50, is withdrawn, thus decreasing the thermal conductivity of each vacuum insulation panel 50. After the vacuum insulation panels 50 have reached a predetermined depressurization level, the valve 43 again closes to line 49 and opens to line 45 so that the cooling system 12 can once again operate. It is conceived that the valve 43 may be the only valve in the active insulation system 20 such that when the compressor 14 activates and the valve 43 is opened to line 49, all insulation portions 22 in the refrigerator 36 are depressurized by the compressor 14. It is also conceived that the valve 43 may be a master valve that allows suction of line 49 but not individual vacuum insulation panels 50. Line 49 connects with a series of control valves 56 in a manifold valving system 54. Each vacuum insulation panel 50 that has an open control valve 56 will be depressurized by way of line 49. However, those vacuum insulation panels 50 that have closed control valves 56 will not be depressurized. The controller 26 will determine which vacuum insulation panels 50 should be depressurized and which should not. It is conceived that sensors disposed at or near valves 56 will measure the pressure level in each line 58 and relay the information to the controller 26, which then determines which control valves 56 should be opened for additional depressurization and which control valves 56 should remain closed because the current depressurization in those vacuum insulation panels 50 are adequate. It will be understood by one having ordinary skill in the art that the embodiment illustrated in FIG. 1 is a closed system variable refrigeration system 10 that includes an active insulation system 20 and a cooling system 12. Neither liquid nor gas is expelled to the environment. It will also be understood that a hybrid system that operates both the cooling system 12 and active insulation system 20 simultaneously may be constructed.

Figure 3:
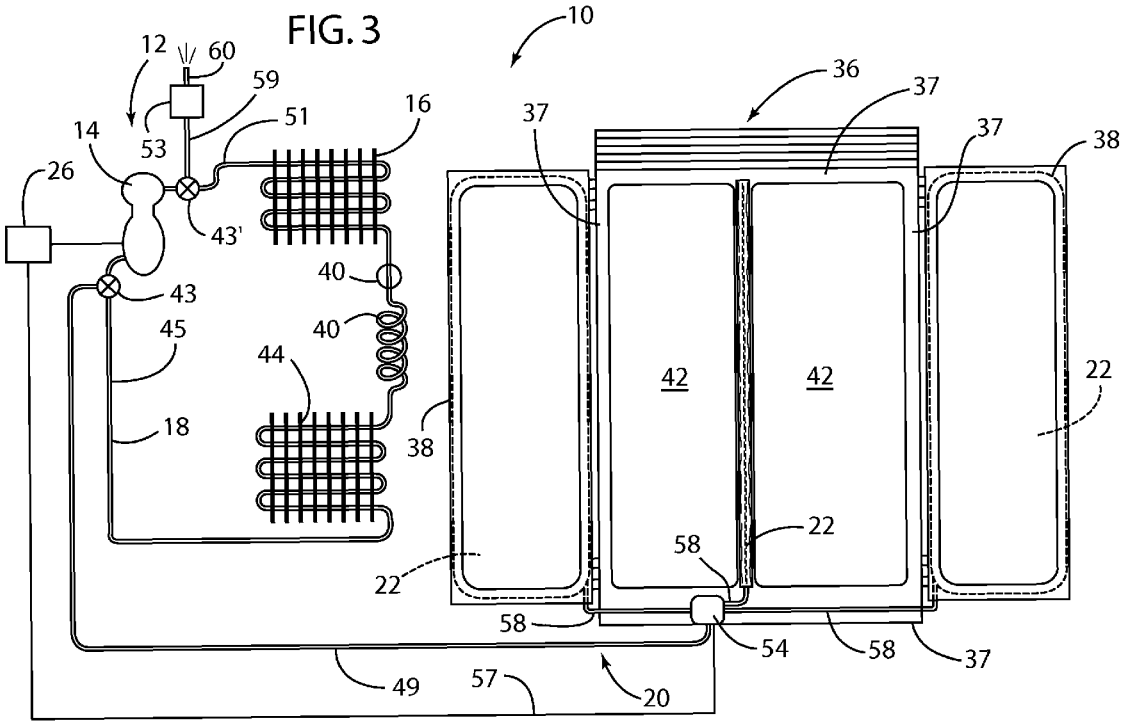
FIG. 3 is a schematic drawing of one embodiment of a variable refrigeration system of the present invention.

As shown in FIG. 3, another embodiment of the variable refrigeration system 10 is illustrated that operates as an open system. The controller 26 is connected to the manifold valving system 54 by way of a signal line 57. The cooling system 12 of this embodiment operates in a similar manner to the cooling system 12 discussed in the previous embodiment. However, the cooling system 12 shown in the embodiment of FIG. 3 includes a release valve 43'. When the cooling system 12 is in operation, the release valve 43' is open to pressure line 51, but closed to a containment line 59.

Referring again to FIG. 3, the controller 26 may send a signal to the compressor 14 to alter the content of the gas 24 in the insulation portion 22 of the active insulation system 20. During this stage, when the vacuum insulation panel 50 has reached a predetermined maximum pressure level due to diffusion of atmospheric gases (air) into the vacuum insulation panel 50, the valve 43 is closed to the line 45 and opened to the line 49. The compressor 14 is activated and acts as a vacuum that evacuates the gas 24 through the line 49 past the valves 56 and from the panel lines 58 in the direction of arrows 47 (FIG. 2). The manifold valving system 54 includes at least one and possibly several control valves 56. Panel line 58 extends from each valve 56 and connects to the vacuum insulation panel 50 disposed in at least one wall 37 or door 38 of the refrigerator 36. The gas 24 is removed from each vacuum insulation panel 50 that has an open control valve 56. The valves 56 on the manifold valving system 54 are designed to allow transfer of the refrigerant 18 between the active insulation system 20 and the cooling system 12 at varying rates. Those vacuum insulation panels 50 that have closed valves 56 are not depressurized. It is contemplated that the vacuum insulation panels 50 could be filled with a porous insulation material that acts as a filler for the volume of the vacuum insulation panel 50. The insulation material may be any of several possible insulation materials, including, but not limited to, fiberglass, vermiculate, and open-celled foam. When the gas 24 is evacuated from the vacuum insulation panel 50, a low K-factor (high R-value) insulation panel 50 is created as the gas 24 content is lowered. Unlike the previously discussed embodiment, this embodiment is an open system that allows vacuumed air from the vacuum insulation panels 50 to be released to the environment. After the gas 24 has been evacuated, the gas 24 is forced out of the variable refrigeration system 10 and into a containment unit 53 through the release valve 43' for disposal or expelled out into the atmosphere through a release line 60. Although only this configuration of components is illustrated, one having skill in the art will appreciate and recognize that various other configurations are possible.

Referring again to the embodiment illustrated in FIGS. 1 and 3, the gas 24 and the refrigerant 18 may be the same and used interchangeably. Specifically, the refrigerant 18 is used as the gas 24 and is in fluid communication with the cooling system 12, as well as the active insulation system 20. Accordingly, the refrigerant 18 is used in both systems 12, 20 to maintain cold storage in compartments 42 in the refrigerator 36, and flows through the line 49 typically in the direction of arrows 47 (FIG. 3) from the vacuum insulation panels 50 to change the thermal conductivity of the vacuum insulation panels 50 in the walls 37 of the refrigerator 36. When refrigerant 18 is vacuumed from the vacuum insulation panel 50, the R-value or thermal resistance of the vacuum insulation panel 50 increases, thereby decreasing heat gain to the selected compartments 42 of the refrigerator 36. The refrigerant 18 may be pumped from a refrigerant reservoir that stores the refrigerant 18 prior to use. The refrigerant 18 may be any one of HFC-245FA, isobutene, carbon dioxide, C-Pentane, or any of many other possible refrigerants. It is contemplated that a lower R-value would be desirable for storing wines, cheeses, or other foods that may require a higher temperature and humidity than is typically used for refrigeration of dairy and meats.

In the embodiment of FIG. 3, it is contemplated that the controller 26 can send a signal to the compressor 14 to allow ambient temperature gas to enter the vacuum insulation panel 50 through valves 43 and 43'. When the ambient temperature gas is supplied to the vacuum insulation panel 50, the walls 37 or doors 38 of the refrigerator 36 raise in temperature, which assists in defrosting of the refrigerator 36. Conversely, as disclosed above, the controller 26 can be used to send a signal to the compressor 14 to withdraw warm gas or air from the vacuum insulation panel 50, thereby lessening heat gain to the interior walls 37 of the refrigerator 36. Alternatively, the gas 24 can be allowed to bleed into the vacuum insulation panels 50, thereby lessening heat gain of the interior walls 37 that house the vacuum insulation panels 50. This function is utilized during a cooling operation or refrigeration of the interior storage compartments 42 of the refrigerator 36.

As shown in FIGS. 2 and 3, the use of manifold valving system 54 allows control over each individual vacuum insulation panel 50. Accordingly, each vacuum insulation panel 50 can be individually adjusted by operation of the compressor 14 based on signals sent by the controller 26 to each valve 56 of the manifold valving system 54. For example, the controller 26 may send a signal to the compressor 14 and valves 43 and 43' to bleed a warm gas 24, such as ambient air, to vacuum insulation panels 50 in one or more walls 37 of a freezer unit to assist in defrosting of the freezer compartment. At the same time, the controller 26 may instruct the compressor 14, after warming the freezer storage compartment, to pump refrigerant 18 from one or more walls 37 adjacent to the refrigerating storage compartment 42. One having ordinary skill in the art will appreciate that any number of possibilities may exist for warming or cooling various walls 37 of the refrigerator 36 at a given time.

Figure 4:
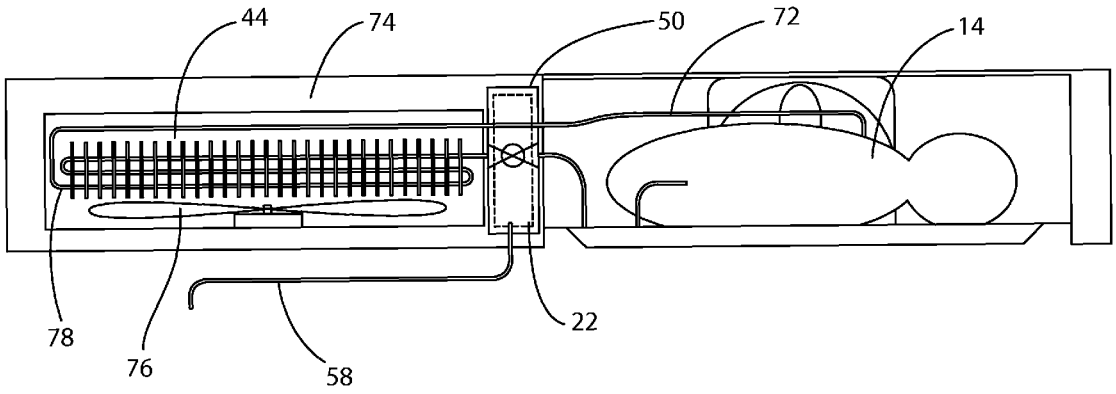
FIG. 4 is a front elevational view of a compressor and evaporator used in one embodiment of the variable refrigeration system.
Figure 5:
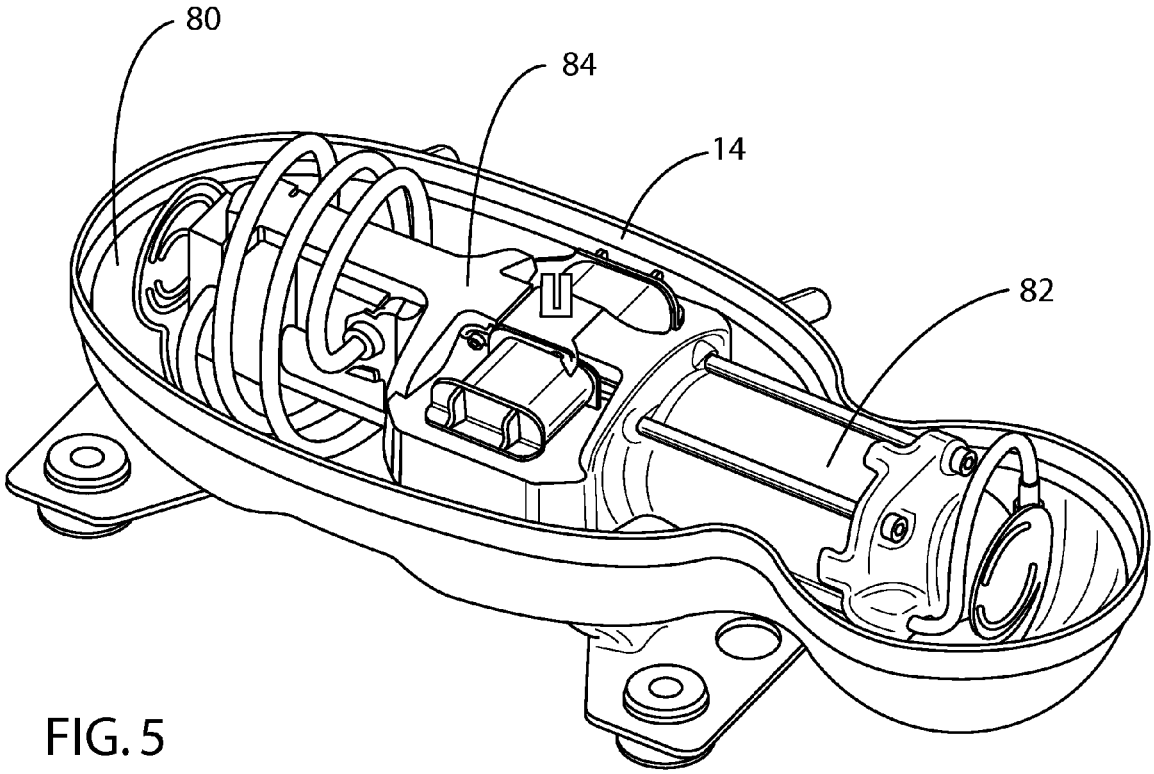
FIG. 5 is a top perspective view of a compressor used in one embodiment of the variable refrigeration system.

Referring now to FIGS. 4 and 5, the compressor 14 is connected to the evaporator 44 by way of a suction line 72. The suction line 72 extends through or adjacent the vacuum insulation panel 50 disposed between the evaporator 44 and the compressor 14. The vacuum insulation panel 50 thermal conductivity can be modified to allow heat from the compressor 14 to dissipate into an evaporator plenum 74 that holds or houses the evaporator 44 during defrosting. During cooling, a fan 76 disposed adjacent the evaporator coils 78 assists in transferring heat to the coils 78 to provide efficient evaporation of refrigerant 18 in the cooling system 12 and subsequent removal of heat from the refrigerated space.

As shown in FIG. 5, the illustrated embodiment of a linear compressor includes a pressure vessel 80 that is evacuated by way of a compressor piston 82. A linear motor system 84 is disposed adjacent to the compressor piston 82 and motivates the same to create a relative vacuum in the pressure vessel 80. It is conceived that any of a variety of compressors 14 could be used to facilitate compression of the refrigerant 18, however, vacuuming the gas 24 out of the vacuum insulation panels 50 is benefited by the illustrated compressor 14 not requiring oil carried by the refrigerant 18 to lubricate the compressor 14 moving components. The linear compressor 14 illustrated in FIG. 5 is able to operate without oil, utilizing a gas bearing as the piston-cylinder lubricant. Without the need for oil, the compressor 14 can be used to compress refrigerant gas 18 or act as a vacuum pump for refrigerant or air.

One embodiment of a method of operating the refrigerator 36 includes providing the cooling system 12 with the compressor 14, the condenser 16, the fan 76, and the refrigerant 18. The active insulation system 20 is provided and includes the insulation portion 22, which is operably connected with the compressor 14. The controller 26 is operably connected to the cooling system 12 and to the active insulation system 20. The controller 26 is set to operate in a first stage to send a signal to the compressor 14 to compress the refrigerant 18. In addition, the controller 26 is set to operate in a second stage to send a signal to the compressor 14 to alter the gas 24 content in the insulation portion 22.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A variable refrigeration system comprising:

a cooling system including a compressor, a condenser, and a refrigerant;

an active insulation system including an insulation portion disposed therein that holds a gas, the insulation portion being operably connected to the compressor and including an insulation panel adjacent a refrigerated compartment; and a controller operably connected to the cooling system and to the active insulation system, the controller operating between a first stage, wherein the controller sends a signal to the compressor to compress the refrigerant in the cooling system, and a second stage, wherein the controller sends a signal to the compressor to alter the gas content in the insulation portion of the active insulation system.

2. The variable refrigeration system of claim 1, wherein the refrigerant serves as the gas.

3. The variable refrigeration system of claim 2, wherein the refrigerant is one of HFC-245FA, isobutene, carbon dioxide, and C-Pentane.

4. The variable refrigeration system of claim 1, wherein the gas pressure in the insulation portion of the active insulation system is in a vacuumed condition.

5. The variable refrigeration system of claim 1, further comprising:

a manifold valving system including at least one valve in communication with the insulation panel, the manifold valving system being operably connected with the controller.

6. The variable refrigeration system of claim 1, further comprising:

a release valve adapted to release gas from the variable refrigeration system.

7. The variable refrigeration system of claim 1, wherein the insulation panel is filled with one of a fiberglass, a vermiculate, or an open-celled foam.

8. A refrigerator comprising:

a cooling system including a compressor, a condenser, and a refrigerant;

an active insulation system including an insulation portion with a gas disposed therein, the insulation portion being operably connected to the compressor; and a controller operably connected to the cooling system and to the active insulation system, the controller operating between a first stage, wherein the controller sends a signal to the cooling system to compress the refrigerant, and a second stage, wherein the controller sends a signal to the compressor to alter the gas content in the insulation portion.

9. The refrigerator of claim 8, wherein the refrigerant serves as the gas.

10. The refrigerator of claim 8, wherein the refrigerant is one of HFC-245FA, isobutene, carbon dioxide, and C-Pentane.

11. The refrigerator of claim 8, wherein the gas pressure in the insulation portion of the active insulation system is in a vacuumed condition.

12. The refrigerator of claim 8, further comprising:

a manifold valving system operably connected with the controller and adapted to release gas from the insulation portion.

13. The refrigerator of claim 8, further comprising:

a release valve adapted to release gas from the refrigerator to one of the environment and a containment unit.

14. A method of operating a refrigerator comprising:

providing a cooling system including a compressor, a condenser, a fan, and a refrigerant;

providing an active insulation system including an insulation portion operably connected to the compressor;

operably connecting a controller to the cooling system and to the active insulation system;

setting the controller to operate in a first stage to send a signal to the compressor to compress the refrigerant; and setting the controller to operate in a second stage to send a signal to the compressor to alter the gas content in the insulation portion.

15. The method of claim 14, further comprising:

setting the controller to operate in the second stage to send a signal to a manifold valving system to supply refrigerant gas to the vacuum insulation portion, thereby allowing heat gain to walls in the refrigerator during defrosting of the refrigerator.

16. The method of claim 14, further comprising:

setting the controller to operate in the second stage to send a signal to the compressor to withdraw gas from the vacuum insulation portion, thereby lessening heat gain to the refrigerator during a cooling operation.

17. The method of claim 14, wherein the step of providing an active insulation system further comprises:

providing multiple insulation portions each of which insulate different compartments of the refrigerator and which are set at predetermined gas pressures based upon the intended use of each compartment.

18. The method of claim 14, further comprising:

filling the insulation portion with the refrigerant.

19. The method of claim 14, wherein the method of setting the controller to operate in a second stage further comprises:

venting air from the insulation portion to the atmosphere.

20. The method of claim 14, further comprising:

operably connecting a manifold valving system with the controller.

* * * * *